US006986672B2

(12) United States Patent
Sasaki et al.

(10) Patent No.: US 6,986,672 B2
(45) Date of Patent: Jan. 17, 2006

(54) ELECTRIC CONTACT STRUCTURE, PROCESS FOR PRODUCING THE SAME AND ELECTRONIC INSTRUMENT HAVING THE SAME

(75) Inventors: Takahiro Sasaki, Kawagoe (JP); Yasuharu Nakamura, Kawagoe (JP); Akira Shimizu, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/792,577

(22) Filed: Mar. 4, 2004

(65) Prior Publication Data

US 2004/0175968 A1 Sep. 9, 2004

(30) Foreign Application Priority Data

Mar. 5, 2003 (JP) ..... 2003-059169

(51) Int. Cl.
*H01R 4/66* (2006.01)

(52) U.S. Cl. ..... 439/92; 439/497

(58) Field of Classification Search ..... 439/72, 439/92, 497, 495

See application file for complete search history.

(56) References Cited

U.S. PATENT DOCUMENTS 2,922,135 A * 1/1960 Rosander et. al. ..... 439/48
3,571,779 A * 3/1971 Collier ..... 439/587
3,980,375 A * 9/1976 LaMarche ..... 439/495
4,215,909 A * 8/1980 Olsen ..... 439/409
4,560,225 A * 12/1985 Margaroli et al. ..... 439/422
4,824,390 A * 4/1989 Crane et al. ..... 439/271
6,077,105 A 6/2000 Jochen et al. ..... 439/497
6,196,868 B1 3/2001 Juntwait ..... 439/497
6,227,900 B1 * 5/2001 Heise ..... 439/426
6,273,753 B1 8/2001 Ko ..... 439/579
6,817,892 B2 * 11/2004 Sakai et al. ..... 439/495
2002/0004332 A1 1/2002 Jochen et al.

FOREIGN PATENT DOCUMENTS

JP 10-51712 A 2/1998

* cited by examiner

*Primary Examiner*—Michael C. Zarroli
(74) *Attorney, Agent, or Firm*—Sughrue Mion, PLLC

(57) ABSTRACT

A multifunctional electronic instrument includes a body of the electronic instrument, an operation display unit movably provided on the body of the electronic instrument, and a ground structure as an electric contact structure, which includes a parallel part and a contact spring piece. The parallel part includes an electrically conductive base material and an electrically insulating surface layer formed on surfaces of both sides of the base material, and is attached to a movable member that moves together with the operation display unit. The parallel part is provided with a projection. At an end of the projection, the base material is exposed in a ruptured part where the surface layer is ruptured. The ruptured part is provided with an electric contact. The contact spring piece comes in contact with the electric contact. The base material of the parallel part and the contact spring piece are electrically connected to each other.

8 Claims, 5 Drawing Sheets

ELECTRIC CONTACT STRUCTURE, PROCESS FOR PRODUCING THE SAME AND ELECTRONIC INSTRUMENT HAVING THE SAME

BACKGROUND OF THE INVENTION (1) Field of the Invention

The present invention relates to an electric contact structure, which is provided in an electronic instrument mounted on a motor vehicle as a mobile unit and is used, for example, to ground a movable part of the electronic instrument, to a process for producing the electric contact structure, and to an electronic instrument having the electric contact structure.

(2) Description of the Related Art

A car stereo (for example, see Japanese Patent Application Laid-Open No. H10-51712) as an electronic instrument is mounted on an instrument panel of a motor vehicle as a mobile unit. The car stereo includes: a body of the car stereo to be mounted on the instrument panel; and a front panel as a movable part, which has a display, such as liquid crystal display, and various operation buttons.

The instrument body (i.e. body of the car stereo) includes a CD player, MD (mini-disc) player, DVD-ROM player for constituting a navigation system and so on. The front panel displays information such as map information in the navigation system and information indicating playback situation of a CD player and MD player on a liquid crystal display or the like. The front panel is provided with a touch switch and push button to be operated when the navigation system, CD player or MD player is driven.

In order to restrict a space for mounting the car stereo to the instrument panel, a face (hereinafter, front face) facing a user of the instrument body is provided with an insertion opening through which the CD player, MD player and DVD-ROM player can be taken into and out from the instrument body. Further, in the car stereo, the front panel is set slidably movable over the range from a position for shielding the front face to a position for opening at least a part of the front face. Therefore, the front panel is attached to the instrument body partially having a small gap therebetween.

The car stereo positions the front panel at a position where at least a part of the front face of the instrument body is opened and then, the CD player, MD player and DVD-ROM player are taken into and out from the instrument body. After the CD player, MD player and DVD-ROM player are inserted into the instrument body, the front panel is shifted to a position for shielding the front face and then, the operation button such as a touch switch and various push buttons are operated so as to drive the CD player, MD player and DVD-ROM player. The information indicating the playback situation of these players is displayed on a liquid crystal display or the like.

In the conventional car stereo, the front panel is set slidably movable over the range from a position for shielding the front face to a position for opening at least a part of the front face. The static electricity might be charged on the front panel of the car stereo. Therefore, in the conventional electronic instrument, in order to remove the static electricity out from the electronic instrument, various electric contact structures (hereinafter, ground structures) for electrically connecting the movable part, such as the front panel, to the instrument body have been used so far.

Further, since the front panel is shifted as described above and therefore exposed to the outside, a sheet metal attached on the front panel is subjected to plating or coating for maintaining its fine sight. Therefore, the sheet metal has an electrically conductive base material and a surface layer formed on a surface of the base material by means of plating or coating. The surface layer is electrically insulating having a significantly larger electrical resistance than that of the base material.

Therefore, in the ground structure as described above, an electrically conductive sheet metal member, such as a sheet metal of the instrument body, to be attached to a chassis is made come in contact with the base material of the sheet metal to be attached on the front panel or the like. When the front panel is shifted, the sheet metal member and the base material of the sheet metal slide with each other, so that they are kept being electrically connected to each other. That is, in the ground structure as described above, the sheet metal member and the base material of the sheet metal are electrically connected to each other. That is, in the ground structure, the front panel and the instrument body are electrically connected to each other.

In the ground structure, when the sheet metal member and the base material of the sheet metal are electrically connected to each other, for example, a part of the surface layer of the sheet metal is removed by grinding. That is, the sheet metal member is made come in contact with thus exposed base material of the sheet metal. Alternatively, in the ground structure, the sheet metal member is made come in contact with the base metal exposed at an end face of the sheet metal. Thus, in the ground structure, the sheet metal member and the base material of the sheet metal are electrically connected to each other.

In the ground structure as described above, the removal of the surface layer by grinding or the like might cause increase in man-hour, that is, increase in cost of the electronic instrument. Further, since the grinding or the like is needed, the production yield might be deteriorated caused by excess grinding of the surface layer of the sheet metal.

Furthermore, when the sheet metal member is made come in contact with the base material exposed at the end face of the sheet metal, the end face of the sheet metal, which becomes rough due to burrs or the like, is scraped by the sheet metal member. Therefore, when the front panel is shifted as described above, a noise might occur.

SUMMARY OF THE INVENTION

It is therefore an objective of the present invention to solve the above problem and to provide an electric contact structure, a process for producing the electric contact structure, and an, electronic instrument having the electric contact structure, by which the cost-up and the deterioration in the yield can be prevented from occurring, and a noise can be prevented from occurring when the members coming in contact with each other are moved relatively to each other.

In order to attain the above objective, the present invention is to provide an electric contact structure comprising:

a first member including an electrically conductive base material and an electrically insulating surface layer formed on a surface of the base material;

an electrically conductive second member which comes in contact with the first member;

a ruptured part of the surface layer of the first member; and an electric contact formed on the ruptured part, which comes in contact with the second member, thereby electrically connecting the base material of the first member and the second member to each other.

In order to attain the above objective, the present invention is to provide an electronic instrument comprising the electric contact structure as described above.

In order to attain the above objective, the present invention is to provide a process for producing an electric contact structure, in which a first member including an electrically conductive base material and an electrically insulating surface layer formed on a surface of the base material comes in contact with an electrically conductive second member so that the base material of the first member is electrically connected to the second member, the process comprising the steps of:

forming a ruptured part on the surface layer of the first member by bending the first member;

forming an electric contact on the ruptured part; and making the second member come in contact with the electric contact formed on the ruptured part.

As described above, in the electric contact structure and the process for producing the electric contact structure according to the present invention, the first member is bent so as to form the ruptured part where the surface layer is ruptured, then an electric contact is provided on the ruptured part. Thus, the man-hour and cost required for processing the first member can be restricted. Moreover, the first and second members can be prevented from being scraped against each other on their rough faces. The contact area between the first and second members is enlarged so that a noise can be prevented from occurring when these members shift relatively to each other.

The present invention is also to provide an electronic instrument including the electric contact structure as described above.

The first member may be attached to one of the body of the electronic instrument and the movable part, both of which are movable relatively to each other, while the second member may be attached to the other one of the body of the electronic instrument and the movable part.

The first member may be attached to the movable part, while the second member may be attached to the body of the electronic instrument.

DESCRIPTION OF THE PREFERRED EMBODIMENTS

In the following, a ground structure as the electric contact structure according to a preferred embodiment of the present invention and a multifunctional electronic instrument as the electronic instrument including such a ground structure will be explained with reference to FIGS. 1–7 and 9. A multifunctional electronic instrument 1 shown in FIG. 1 and so on is mounted on an instrument panel of a motor vehicle as a mobile unit.

Figure 1:
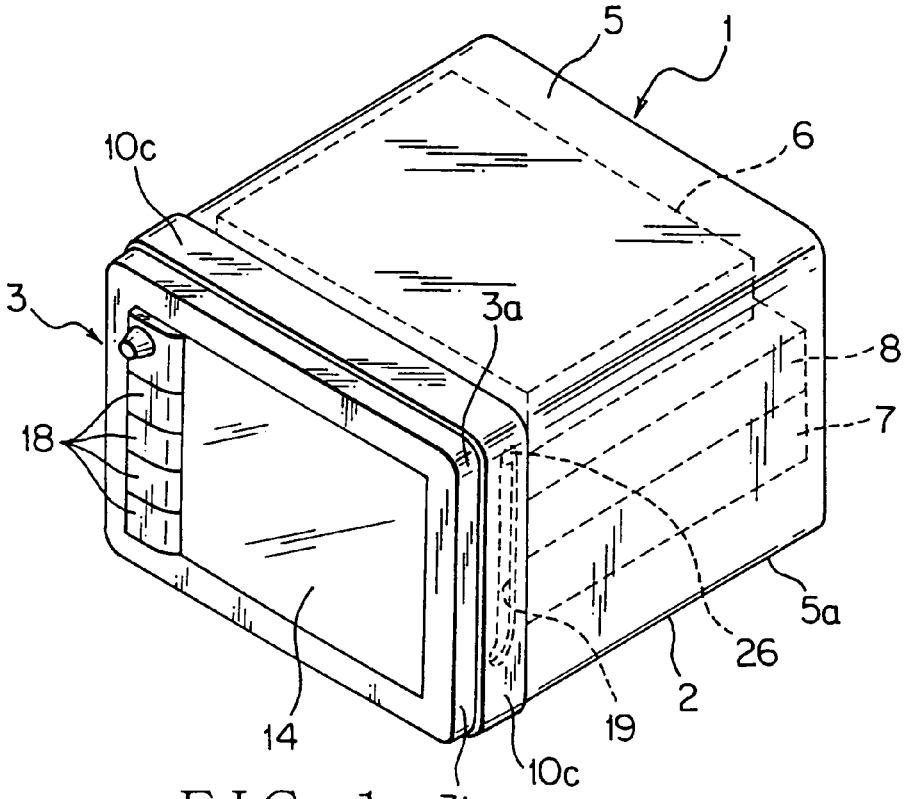
FIG. 1 is a perspective view illustrating an appearance of a multifunctional electronic instrument according to a preferred embodiment of the present invention.
Figure 2:
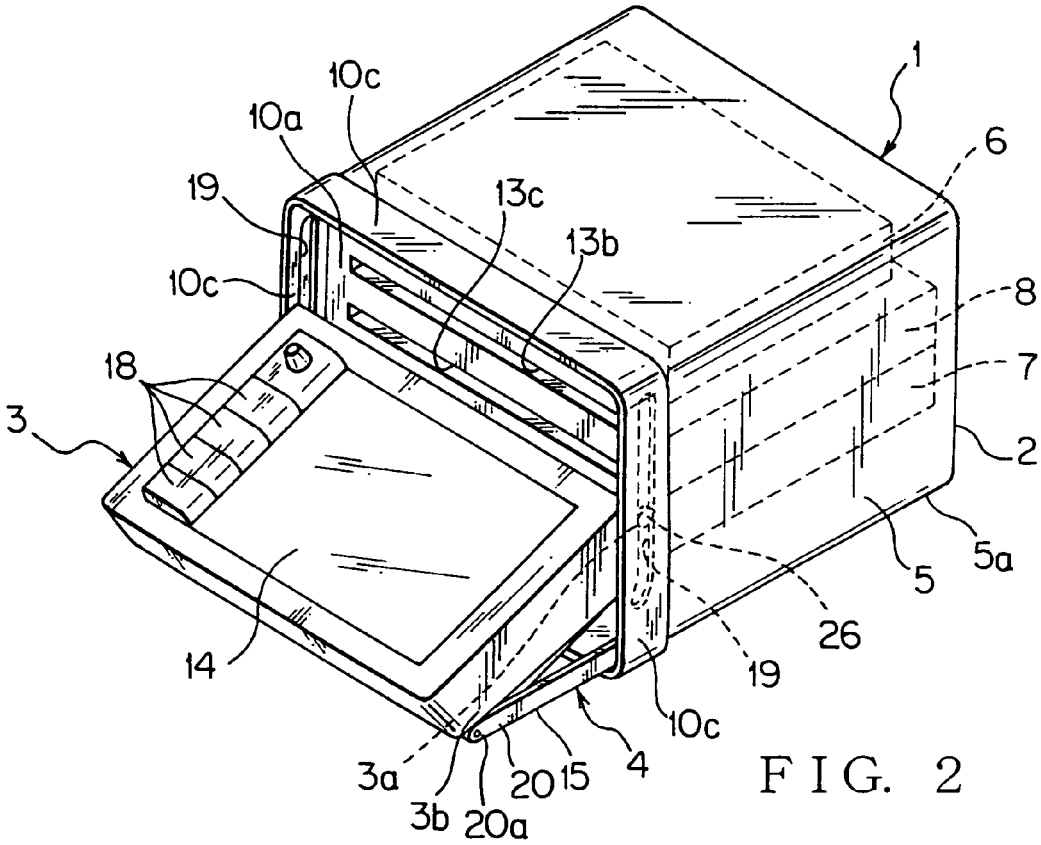
FIG. 2 is a perspective view illustrating a state when an operation display unit of the multifunctional electronic instrument shown in FIG. 1 is positioned at the third position.
Figure 3:
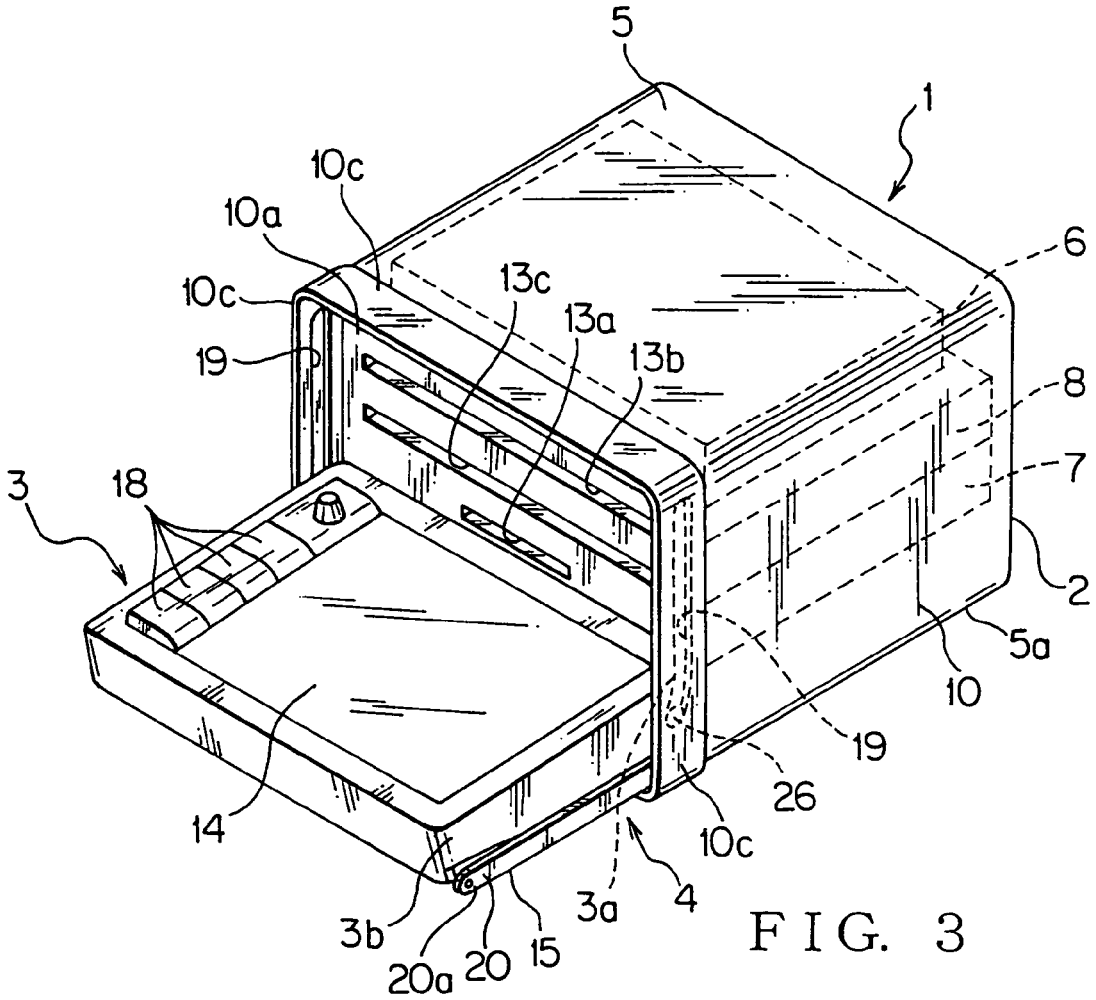
FIG. 3 is a perspective view illustrating a state when an operation display unit of the multifunctional electronic instrument shown in FIG. 1 is positioned at the first position.

As shown in FIGS. 1–3, the multifunctional electronic instrument 1 includes a body 2 of the electronic instrument, an operation display unit 3 as a front panel, a drive mechanism 4 (shown in FIGS. 2 and 3) that slidably moves the operation display unit 3 relatively to a front face 10*a* (explained later on), a ground structure 9 (shown in FIGS. 4 and 5) as the electric contact structure, and so on.

The body 2 of the electronic instrument includes a box-shaped casing 5, a chassis 10 (shown in FIG. 4) to be received in the casing 5, the front face 10*a* as a face provided in front of the casing 5, and playback devices such as a CD player 6 and so on, which are received in the casing 5. The casing 5 includes a plurality of standing walls 10*c* that are integrally formed at all sides of the front face 10*a*. A space zone formed by a plurality of the standing walls 10*c* receives the operation display unit 3 rotatably.

Each inner face of the respective standing walls 10*c* located at both sides of the operation display unit 3 received in the space zone described above is provided with a guide groove 19 as a slide groove extending in the vertical direction. The guide groove 19 is formed becoming hollow from the inner face of the standing walls 10*c*. The guide groove 19 slidably engages with a roller 26 (explained later on) which is projectingly formed on both sides of an upper end 3*a* of the operation display unit 3.

Figure 4:
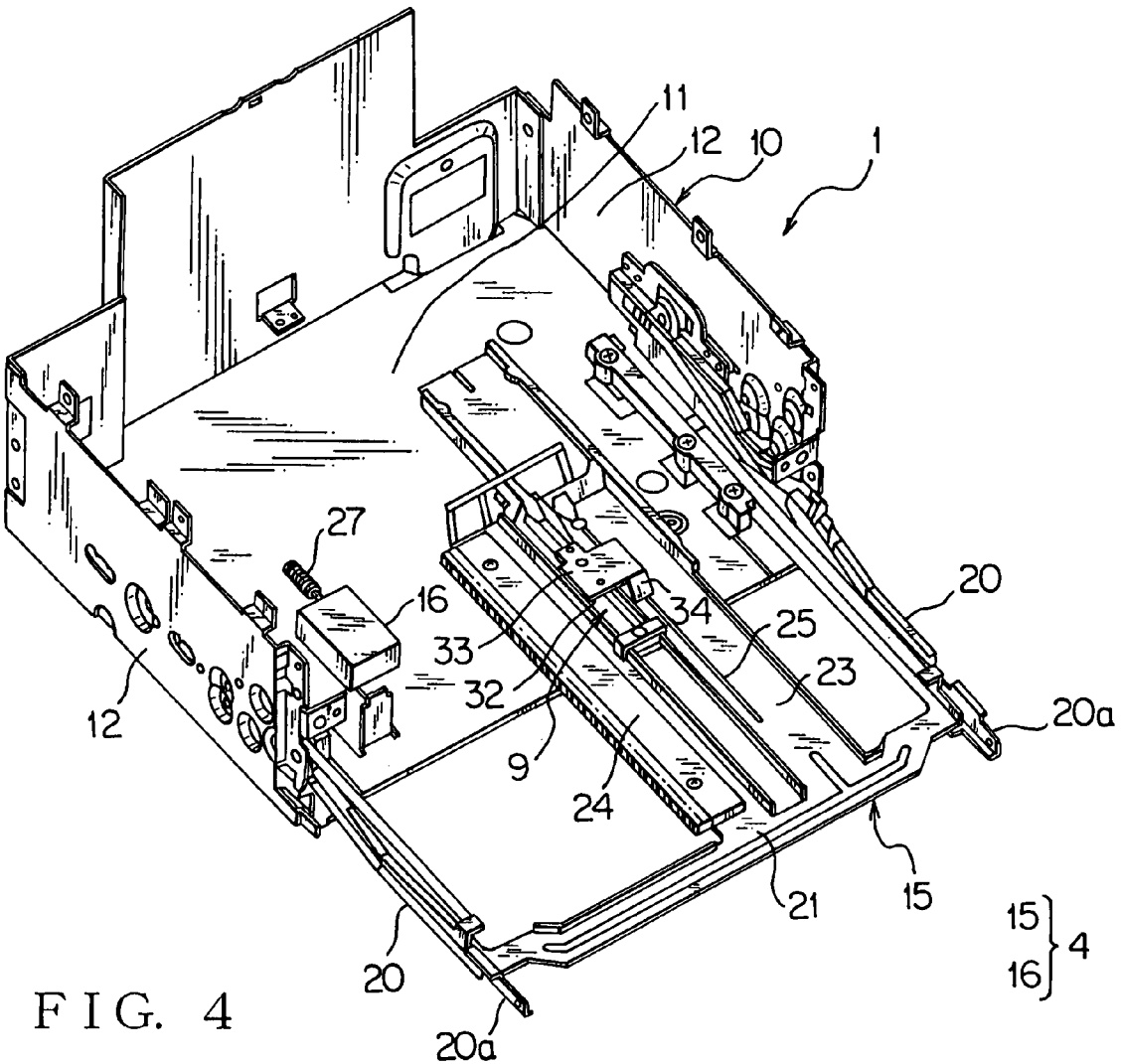
FIG. 4 is a perspective view illustrating a primary part of the multifunctional electronic instrument shown in FIG. 3.

The chassis 10 is made of a sheet metal or the like, and includes a flat plate-shaped bottom chassis 11, a side chassis 12 standing up from both edges of the bottom chassis 11 in the width direction thereof and so on, as shown in FIG. 4. The bottom chassis 11 is piled up on a bottom wall 5*a* (shown in FIG. 1 or 3) of the casing 5 of the body 2 of the electronic instrument.

In the example shown in the figures, the casing 5 receives a CD player 6 and MD player 7 each as a playback device and a DVD-ROM player 8 for constituting a navigation system. Although it is not shown in the figures, the casing 5 receives an AM/FM tuner for receiving radio broadcasting, a television tuner for receiving television broadcasting and so on. A user pushes a push button 18 (explained later on) or the like provided in the operation display unit 3 so as to operate these playback devices and receivers.

As shown in FIG. 3, the front face 10*a* is provided with a slit 13*a* for inserting a MD into the MD player 7 therethrough, an insertion opening 13*b* and insertion opening 13*c* for inserting a CD and DVD-ROM into the CD player 6 and the DVD-ROM player 8 therethrough, respectively.

The operation display unit 3 includes a display panel 14 such as a liquid crystal display for displaying image information. The operation display unit 3 displays map information playbacked by the DVD-ROM player 8, images of television broadcasting received by the television tuner and so forth on the display panel 14.

The operation display unit 3 is provided with a roller 26 at both sides of its upper end 3*a*. The roller 26 is formed in a disc-shape and provided rotatably around the axis at both sides of the upper end 3*a* of the operation display unit 3. The roller 26 protrudes from the side of the operation display unit 3.

The roller 26 engages with the guide groove 19 and rotates around the axis, thereby being set movable along the guide groove 19. The roller 26 engages with the guide groove 19 having a small gap therebetween so as to smoothly slide along the guide groove 19.

The operation display unit 3 is provided with a plurality of push buttons 18 on its surface. When the push button 18 is operated by a user, various playback devices 6, 7 and 8 received in the casing 5 are set in operation.

When the push button 18 is pushed, the operation display unit 3 is shifted within the first position shown in FIG. 3, the second position shown in FIG. 1, and the third position shown in FIG. 2, which is located between the first and second positions. The roller 26 moves within the guide groove 19 by an action of the drive mechanism 4, thereby shifting the operation display unit 3 between the first and second positions.

The operation display unit 3 is shifted to the first, third and second positions in sequence. The operation display unit 3 is also shifted to the second, third and first positions in sequence. At this time, a lower end 3*b* of the operation display unit 3 protrudes from or retires to the front face 10*a* and the upper end 3*a* of the operation display unit 3 slides along the front face 10*a*.

As shown in FIG. 3, at the first position, the slit 13*a* and insertion openings 13*b* and 13*c* provided on the front face 10*a* are all opened. That is, at the first position, the operation display unit 3 opens the front face 10*a*. As shown in FIG. 2, at the third position, the operation display unit 3 shields the slit 13*a* and opens the insertion openings 13*b* and 13*c*.

At the third position, the operation display unit 3 shields a part of the front face 10*a*. As shown in FIG. 1, at the second position, the operation display unit 3 shields the slit 13*a* and insertion openings 13*b* and 13*c*. That is, at the second position, the operation display unit 3 shields the whole front face 10*a*.

For example, when a selection button (such as a button for selecting the CD player, MD player and so on) of the push buttons 18 or an OPEN button is pushed, the operation display unit 3 is slidingly shifted by the drive mechanism 4. That is, when the CD player is selected with the selection button, the drive mechanism 4 slidingly shifts the operation display unit 3 to the third position.

When the OPEN button is pushed, the drive mechanism 4 slidingly shifts the operation display unit 3 to the first position at which the slit 13*a* and insertion openings 13*b* and 13*c* formed on the front face 10*a* of the chassis 10 are all opened. When a desired disc for the CD player, MD player or the like is inserted into or taken out from the slit 13*a*, insertion opening 13*b* or 13*c*, the drive mechanism 4 automatically shifts the operation display unit 3 to the second position at which the slit 13*a* and insertion openings 13*b* and 13*c* formed on the front face 10*a* of the chassis 10 are all shielded.

In a state when the front face 16*a* is opened with the operation display unit 3 being positioned at the first or third position; when a desired disc is inserted, then the operation display unit 3 is automatically shifted to the second position. Thereafter, when a user pushes a palyback button of the push buttons 18 or a search button, a playback of the corresponding disc or a search action is carried out.

The sliding shift of the operation display unit 3 is carried out when a microcomputer (not shown in the figures) or the like controls the rotational direction and/or number of revolution of a motor (explained later on) of the drive mechanism 4. That is, the microcomputer recognizes a user's operation of the push buttons 18 or insertion of a disc, then controls the rotational direction and/or number of revolution of the motor so as to slidingly shift the operation display unit 3 to the corresponding position.

The drive mechanism 4 includes a movable member 15, motor 16 as a drive source, and power transmission part (not shown in the figures). As shown in FIG. 4, the movable member 15 includes in one piece a pair of arms 20 and a connecting part 21 for connecting the pair of the arms 20 to each other.

The arm 20 is formed in a belt-shape extending straight. The movable member 15 is supported by the chassis 10 on a condition that the longitudinal direction of the arm 20 crosses the front face 10*a* at right angles. Therefore, the movable member 15 is supported by the chassis 10 moving slidably along the longitudinal direction of the arm 20. That is, the movable member 15 is provided moving slidably in the direction crossing the front face 10*a* at right angles. When the movable member 15 slides, an end 20*a* of the arm 20 near to the operation display unit 3 protrudes from or retires to the front face 10*a*.

The two arms 20 are provided along respective inner surfaces of side chassis 12 of the chassis 10. The end 20*a* of each arm 20 is provided with a hole which rotatably engages with a pin provided on the corresponding side of the lower end 3*b* of the operation display unit 3. Therefore, the arm 20, i.e. movable member 15 rotatably supports the lower end 3*b* of the operation display unit 3 and shifts together with the operation display unit 3. Further, the movable member 15 is electrically connected to the operation display unit 3.

Both ends of the connecting part 21 continue to the pair of the arms 20 and the longitudinal direction of the connecting part 21 crosses the longitudinal direction of the arm 20 at right angles. The connecting part 21 is formed in a belt-shape extending straight. The connecting part 21 continues to a parallel part 23. The longitudinal direction of the connecting part 23 is parallel to the longitudinal direction of the arm 20. The parallel part 23 is formed in a belt-shape extending straight.

The parallel part 23 is provided with a rack 24 which engages with a gear (not shown in the figure) of the power transmission part. The parallel part 23 is provided with a projection 25 formed by pressing such as bending and/or drawing. That is, the parallel part 23 is bent so as to form the projection 25.

Figure 6:
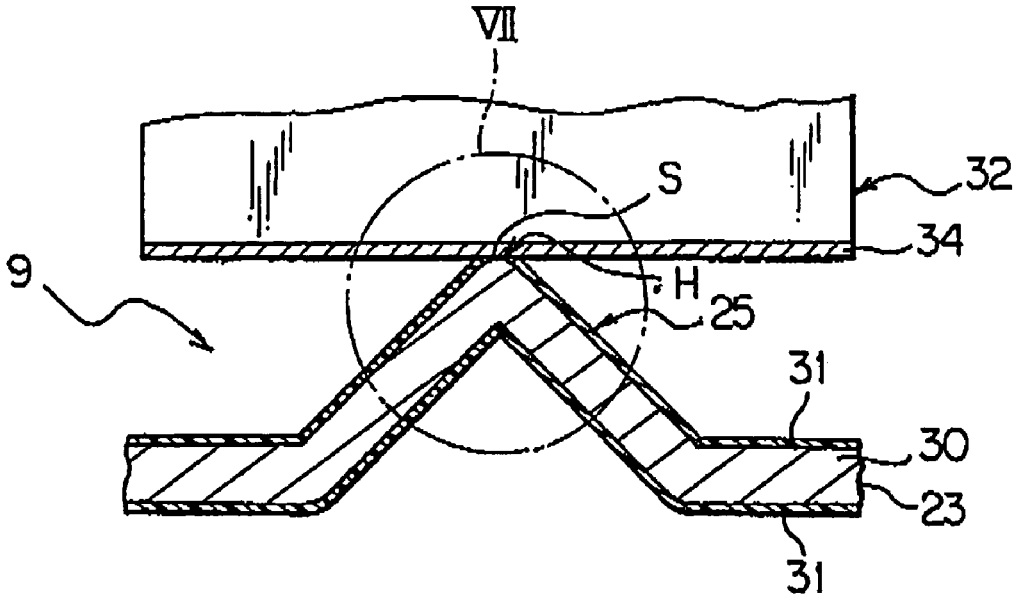
FIG. 6 is a cross sectional view taken along VI—VI line in FIG. 5.
Figure 7:
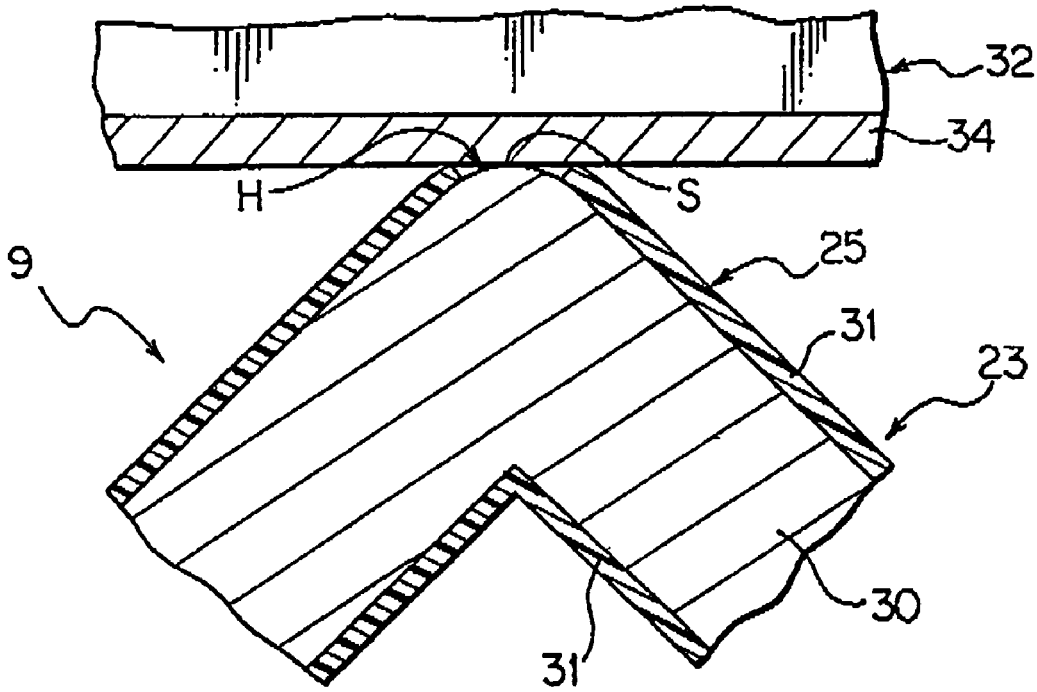
FIG. 7 is an enlarged illustration of the part VII shown in FIG. 6.

The projection 25 is formed projectingly upward from the parallel part 23, that is, toward a contact spring piece 32 (explained later on). As shown in FIGS. 6 and 7, a surface of the projection 25 is formed in a convex curved face-shape upward, that is, toward the contact spring piece 32. The projection 25 extends along the sliding direction of the movable member 15.

The parallel part 23 corresponds to the first member defined in this specification. The parallel part 23, i.e. the movable member 15 is made of a sheet metal and, as shown in FIGS. 6 and 7, includes an electrically conductive base material 30 and a surface layer 31 formed on both surfaces of the base material 30. The base material 30 is made of electrically conductive metal. Both surfaces of the base material 30 are subjected to plating or coating so as to form the surface layer 31. The surface layer 31 is electrically insulating, that is, has high electric resistance. The connecting part 21 and the arm 20, both of which continue to the parallel part 23, have the same structure as that of the parallel part 23, that is, include the base material 30 and the surface layer 31.

As shown in FIG. 7, a ruptured part H, at which a part of the surface layer 31 is ruptured, is provided at an end of the projection 25. At the ruptured part H, the base material 30 is exposed. An electric contact S defined in this specification is provided on the ruptured part H. That is, the parallel part 23 is provided with the electric contact S on its ruptured part H. In an example shown in the figures, the base material 30 is completely exposed at the ruptured part H.

The motor 16 is attached on a bottom chassis 11 of the chassis 10. A pinion 27 is attached to an output shaft of the motor 16. The power transmission includes a plurality of gears, which engage with each other. These gears rotatably supported by the bottom chassis 11. One gear engages with the pinion 27 and the other gear engages with the rack 24.

Therefore, the drive force of the motor 16 is transmitted to the rack 24 through the power transmission part so that the movable member 15 is slidingly shifted relatively to the chassis 10 in the longitudinal direction of the arm 20. That is, by the drive force of the motor 16, the arm 20 of the movable member 15 is shifted in the inward or outward direction of the chassis 10 through a through hole (not shown in the figure) formed below the front face 10*a*.

In the drive mechanism 4, the movable member 15 is shifted in the inward or outward direction of the chassis 10 by the drive force from the motor 16. Further, when each movable member 15 shifts in the inward or outward direction of the chassis 10, the roller 26 provided in the operation display unit 3 slides along the guide groove 19.

That is, when the movable member 15 is shifted in the outward direction from the chassis 10 by receiving the drive force from the motor 16, the operation display unit 3 falls down with its surface facing upward. Then, the operation display unit 3 is shifted to the first or the third position at which the front face 10*a* of the chassis 10 is opened. When the movable member 15 is shifted in the inward direction to the chassis 10, the operation display unit 3 that has been fallen down is shifted to the first position and the roller 26 is positioned at the upper end of the guide groove 19.

The operation display unit 3 and the movable member 15 are shifted within the range between the first and second positions by the drive force from the motor 16. That is, the operation display unit 3 and the movable member 15 are provided movably relatively to the body 2 of the electronic instrument. The operation display unit 3 and the movable member 15 correspond to the movable part defined in this specification.

Figure 5:
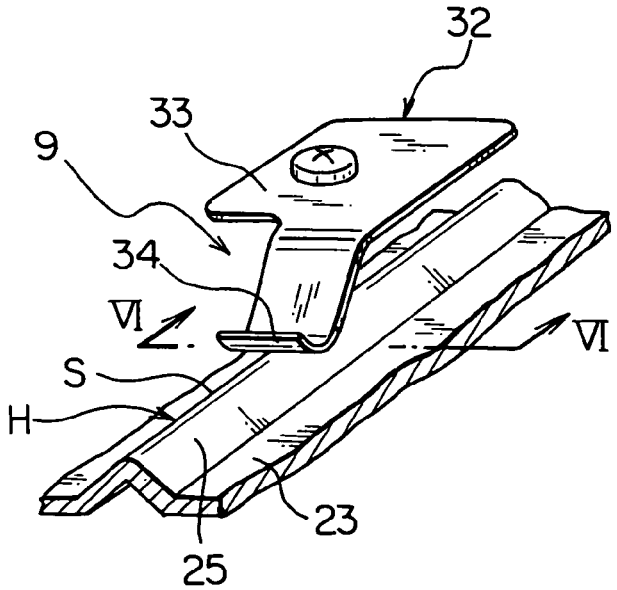
FIG. 5 is an enlarged perspective view of a ground structure of the multifunctional electronic instrument shown in FIG. 4.

As shown in FIGS. 4, 5 and 7, the ground structure 9 includes the parallel part 23 as the first member and the contact spring piece 32 as the second member. The ground structure 9 makes the parallel part 23 and the contact spring piece 32 come in contact with each other so as to electrically connect the base material 30 of the parallel part 23 and the contact spring piece 32 to each other.

As described above, the parallel part 23 includes the base material 30 and the surface layer 31. The parallel part 23 is also provided with the projection 25, at the end of which the ruptured part H is provided. A part of the surface layer 31 is ruptured so as to form the ruptured part H. The projection 25 is obtained by bending the parallel part 23. That is, the parallel part 23 is bent so as to form the ruptured part H where a part of the surface layer 31 is ruptured and the electrical contact S is provided on the ruptured part H. The parallel part 23 continues to the connecting part 21 of the movable member 15. That is, the parallel part 23 is attached to the movable part 15.

The contact spring piece 32 is made of electrically conductive sheet metal. As shown in FIGS. 4 and 5, the contact spring piece 32 includes in one piece a mount 33 and a resilient contact part 34. The mount 33 is attached on the bottom chassis 11 of the chassis 10, i.e. on the body 2 of the electronic instrument by a screw or the like. That is, the contact spring piece 32 is attached on the body 2 of the electronic instrument.

The resilient contact part 34 extends toward the projection 25 provided on the parallel part 23 from the mount 33. The resilient contact part 34, i.e. the contact spring piece 32 comes in contact with the end of the projection 25, i.e. with the electric contact S provided on the ruptured part H, that is, comes in contact with the base material 30. The resilient contact part 34 comes in contact with the electric contact S on a condition that the resilient contact part 34 generates a resilient restoring force, which biases the electric contact S toward the bottom chassis 11.

In the ground structure 9 constructed as described above, even if the movable member 15 slides as described above when the operation display unit 3 shifts within the range between the first and second positions, the resilient contact part 34 of the contact spring piece 32 comes in contact with the electric contact S provided on the parallel part 23. That is, in the ground structure 9, even if the movable member 15 shifts so that the contact spring piece 32 and the parallel part 23 move relatively to each other, the resilient contact part 34, i.e. the contact spring piece 32 comes in contact with the electric contact S, that is, with the base material 30.

In the ground structure 9, the base material 30 of the movable member 15 is electrically connected to the contact spring piece 32, thereby electrically connecting the operation display unit 3 to the chassis 10, that is, to the body 2 of the electronic instrument. Therefore, in the ground structure 9, the static electricity charged in the operation display unit 3 and the movable member 15 can be released outside the multifunctional electronic instrument 1 through the chassis 10, i.e. through the body 2 of the electronic instrument.

The ground structure 9 as described above may be produced as follows. First, the flat plate-shaped parallel part 23, in which the surface layer 31 is formed on both surfaces of the base material 30, is subjected to pressing such as bending and/or drawing. The projection 25 is formed on the parallel part 23, that is, the parallel part 23 is bent. At this time, as shown in FIG. 7, a part of the surface layer 31 is ruptured at the end of the projection 25 so as to forming the ruptured part H where the base material 30 is exposed.

Then, the electric contact S is formed on the ruptured part H. The contact spring piece 32 is fixed to the chassis 10 on a condition that the resilient contact part 34 comes in contact with the electric contact S. That is, the resilient contact part 34 of the contact spring piece 32 is made come in contact with the base material 30 exposed at the electric contact S. At this time, the base material 30 of the parallel part 23 is electrically connected to the contact spring piece 32. Thus, the ground structure 9 is obtained.

Figure 9:
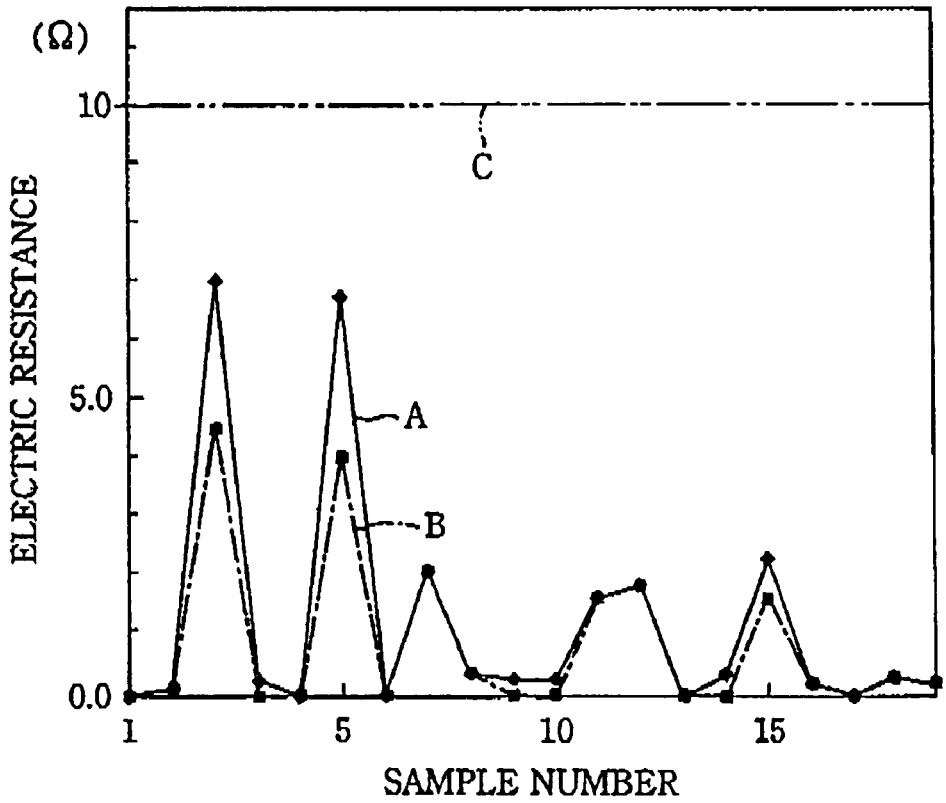
FIG. 9 is a graph illustrating measured values of electric resistance for the ground structure shown in FIG. 6 and a comparative example.

An effect of the ground structure 9 as described above was actually confirmed. The results are shown in FIG. 9. In FIG. 9, as for products A and B according to the present invention indicated by a solid line and an alternate long and short dash line, respectively, a plate material including the base material 30 and the surface layer 31 was subjected to bending so as to form the projection 25 and the electric contact S was formed, thereby producing the parallel part 23 as the first member. Further, as for the products A and B according to the present invention, the contact spring pieces 32 were also produced.

The electric contact S of the parallel part 23 was made come in contact with the contact spring pieces 32, then the electric resistance between the base material 30 of the parallel part 23 and the contact spring pieces 32 was measured. A plurality of samples (twenty samples) for each of the products A and B according to the present invention, each of which includes the parallel part 23 and the contact spring piece 32, were produced, then each electric resistance of the products was measured. Here, in detail, as for each sample for the product A, the electric resistance when the operation display unit 3 is positioned at the first position was measured. As for each sample for the product B, the electric resistance when the operation display unit 3 is positioned at the second position was measured.

In addition, as for comparative examples C indicated by an alternate long and two short dashes line in FIG. 9, the parallel part 23, in which the projection 25 was not formed, that is, a part of the surface layer 31 was not ruptured, was made come in contact with the contact spring pieces 32, thereby producing the comparative examples C. Then, the electric resistance between the base material 30 of the parallel part 23 and the contact spring piece 32 was measured. As for the comparative examples C, a plurality of the samples (twenty samples), each of which includes the parallel part 23 and the contact spring piece 32, were produced, then each electric resistance was measured.

Further, as for the products A and B according to the present invention and the comparative examples C, both surfaces of the base material 30 of the parallel part 23 was subjected to plating so as to form the surface layer 31 consisting of black Zn—Ni alloy plating, in which a blacked layer is given on a surface of Zn—Ni alloy plating.

The results shown in FIG. 9 reveals that the electric resistance was 10 ohms for the comparative samples C. On the other hand, the electric resistance was at most 7 ohms for the products A and B according to the present invention and was actually 0 ohm for the most products. Thus, as for the products A and B according to the present invention, it was confirmed that the electric resistance could be significantly reduced by providing the electric contact S on the ruptured part H which was formed by rupturing a part of the surface layer 31. That is, it was confirmed that the base material 30 of the parallel part 23 could be securely electrically connected to the contact spring piece 32.

In the preferred embodiment as described above, the parallel part 23 is bent so as to form the ruptured part H which was formed by rupturing a part of the surface layer 31 and to provide the electric contact S on the ruptured part H. Thus, since the electric contact S can be easily provided by simply bending the parallel part 23, therefore the man-hour, i.e. cost of processing the parallel part 23 can be reduced. Further, since the parallel part 23 can be subjected to pressing by using a die or the like, the degree of bending of the parallel part 23 can be set uniform, thereby preventing the deterioration in the production yield.

Further, since the parallel part 23 is bent so as to form the ruptured part H which was formed by rupturing a part of the surface layer 31 and to provide the electric contact S on the ruptured part H, therefore the parallel part 23 and the contact spring piece 32 can be prevented from being scraped against each other on their rough faces. The contact area between the parallel part 23 and the contact spring piece 32 can be enlarged compared to a case in which the contact spring piece 32 is made come in contact with an end face of the parallel part 23 or the like. Therefore, even if the parallel part 23 and the contact spring piece 32 shift relatively to each other, a noise can be prevented from occurring.

The multifunctional electronic instrument 1 as the electronic instrument includes the ground structure 9 as described above. Therefore, the operation display unit 3 can be securely electrically connected to the chassis 10, i.e. to the body 2 of the electronic instrument through the movable member 15. Therefore, the multifunctional electronic instrument 1 can release the static electricity charged in the operation display unit 3 to the outside through the body 2 of the electronic instrument.

The parallel part 23 is attached to the movable member 15 and the contact spring piece 32 is attached on the body 2 of the electronic instrument. Therefore, the body 2 of the electronic instrument can be securely electrically connected to the movable member 15. Therefore, the static electricity charged in the movable member 15, i.e. in the operation display unit 3 can be released outside the multifunctional electronic instrument 1 through the body 2 of the electronic instrument.

Figure 8:
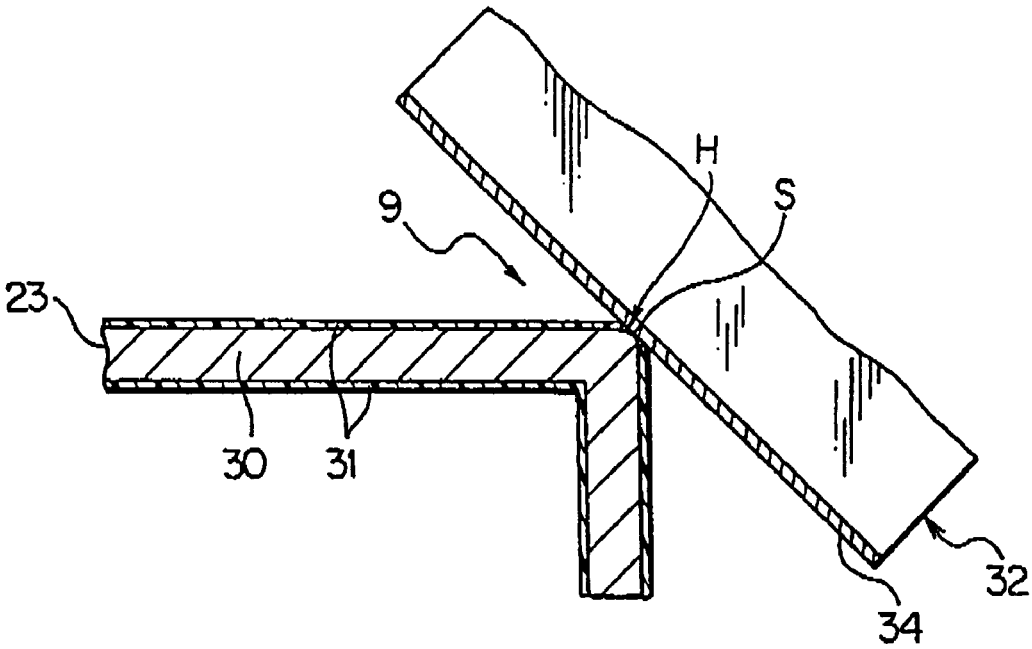
FIG. 8 is a cross sectional view illustrating another preferred embodiment of the ground structure shown in FIG. 6.

In the preferred embodiment as described above, the projection 25 is formed so as to provide the electric contact S. However, as shown in FIG. 8, without bending the parallel part 23 so as to form the projection 25, the parallel part 23 may be bent so that the electric contact S is provided on the ruptured part H at which a part of the surface layer 31 is ruptured. In this case as well, the base material 30 of the parallel part 23 can be securely electrically connected to the contact spring piece 32.

In the preferred embodiment as described above, the parallel part 23 is attached to the movable member 15 and the contact spring piece 32 is attached on the body 2 of the electronic instrument. However, instead, the parallel part 23 as the first member may be attached on the body 2 of the electronic instrument and the contact spring piece 32 may be attached to the movable member 15.

In short, in the present invention, the parallel part 23 as the first member may be attached to one of the body 2 of the electronic instrument and the movable member 15, while the contact spring piece 32 as the second member may be attached to the other of the body 2 of the electronic instrument and the movable member 15. In this case as well, the body 2 of the electronic instrument can be securely electrically connected to the movable member 15. Therefore, the static electricity charged in the movable member 15, i.e. in the operation display unit 3 can be released outside the multifunctional electronic instrument 1 through the body 2 of the electronic instrument.

In the preferred embodiment as described above, the base material 30 is completely exposed at the electric contact S provided on the ruptured part H. That is, no surface layer 31 remains on the surface of the base material 30 there. However, instead, on the ruptured part H, a part of the surface layer 31 may remain on the surface of the base material 30. That is, the contact spring piece 32 may be made come in contact with the electric contact S provided on the ruptured part H where a part of the surface layer 31 remains on the surface of the base material 30.

According to the preferred embodiment described above, the following ground structure, multifunctional electronic instrument and process for producing the ground structure can be obtained.

[ADDITIONAL REMARK 1]

A ground structure 9 comprising:

a parallel part 23 including an electrically conductive base material 30 and an electrically insulating surface layer 31 formed on a surface of the base material 30;

an electrically conductive contact spring piece 32, which comes in contact with the parallel part 23;

a ruptured part H of the surface layer 31 of the parallel part 23; and an electric contact S formed on the ruptured part H, which comes in contact with the contact spring piece 32, thereby electrically connecting the base material 30 of the parallel part 23 and the contact spring piece 32 to each other.

[ADDITIONAL REMARK 2]

A multifunctional electronic instrument 1 comprising the ground structure 9 as defined in ADDITIONAL REMARK 1.

[ADDITIONAL REMARK 3]

The multifunctional electronic instrument 1 as defined in ADDITIONAL REMARK 2 comprising:

a body 2 of the electronic instrument; and a movable part 15 provided movably relatively to the body 2 of the electronic instrument, wherein the parallel part 23 is attached to one of the body 2 of the electronic instrument and the movable part 15, while the contact spring piece 32 is attached to the other one of the body 2 of the electronic instrument and the movable part 15.

[ADDITIONAL REMARK 4]

The multifunctional electronic instrument 1 as defined in ADDITIONAL REMARK 2 comprising:

a body 2 of the electronic instrument; and a movable part 15 provided movably relatively to the body 2 of the electronic instrument, wherein the parallel part 23 is attached to the movable part 15 while the contact spring piece 32 is attached to the body 2 of the electronic instrument.

[ADDITIONAL REMARK 5]

A process for producing a ground structure 9, in which a parallel part 23 including an electrically conductive base material 30 and an electrically insulating surface layer 31 formed on a surface of the base material 30 comes in contact with an electrically conductive contact spring piece 32 so that the base material 30 of the parallel part 23 is electrically connected to the contact spring piece 32, the process comprising the steps of:

forming a ruptured part H on the surface layer 31 of the parallel part 23 by bending the parallel part 23;

forming an electric contact S on the ruptured part H; and making the contact spring piece 32 come in contact with the electric contact S formed on the ruptured part H.

According to the ground structure 9 described in ADDITIONAL REMARK 1 and a process for producing the ground structure described in ADDITIONAL REMARK 5, the parallel part 23 is bent so as to form the ruptured part H where a part of the surface layer 31 is ruptured and the electric contact S is provided on the ruptured part H. Thus, since the electric contact S can be easily provided by simply bending the parallel part 23, therefore the man-hour, i.e. cost of processing the parallel part 23 can be reduced. Further, since the parallel part 23 can be subjected to pressing by using a die or the like, the degree of bending of the parallel part 23 can be set uniform, thereby preventing the deterioration in the production yield.

Further, since the parallel part 23 is bent so as to form the ruptured part H which was formed by rupturing a part of the surface layer 31 and to provide the electric contact S on the ruptured part H, therefore the parallel part 23 and the contact spring piece 32 can be prevented from being scraped against each other on their rough faces. The contact area between the parallel part 23 and the contact spring piece 32 can be enlarged compared to a case in which the contact spring piece 32 is made come in contact with an end face of the parallel part 23 or the like. Therefore, even if the parallel part 23 and the contact spring piece 32 shift relatively to each other, a noise can be prevented from occurring.

According to the multifunctional electronic instrument 1 described in ADDITIONAL REMARK 2, the multifunctional electronic instrument 1 includes the ground structure 9, in which the parallel part 23 is bent so as to form the ruptured part H where a part of the surface layer 31 is ruptured and the electric contact S is provided on the ruptured part H. Thus, since the electric contact S can be easily provided by simply bending the parallel part 23, therefore the man-hour, i.e. cost of processing the parallel part 23 can be reduced. Further, since the parallel part 23 can be subjected to pressing by using a die or the like, the degree of bending of the parallel part 23 can be set uniform, thereby preventing the deterioration in the production yield.

Further, since the parallel part 23 is bent so as to form the ruptured part H which was formed by rupturing a part of the surface layer 31 and to provide the electric contact S on the ruptured part H, therefore the parallel part 23 and the contact spring piece 32 can be prevented from being scraped against each other on their rough faces. The contact area between the parallel part 23 and the contact spring piece 32 can be enlarged compared to a case in which the contact spring piece 32 is made come in contact with an end face of the parallel part 23 or the like. Therefore, even if the parallel part 23 and the contact spring piece 32 shift relatively to each other, a noise can be prevented from occurring.

Furthermore, the parallel part 23 can be securely electrically-connected to the contact spring piece 32, that is, the operation display unit 3 can be securely electrically connected to the body 2 of the electronic instrument. Therefore, the static electricity charged in the operation display unit 3 can be released to the outside through the body 2 of the electronic instrument.

According to the multifunctional electronic instrument 1 described in ADDITIONAL REMARK 3, the parallel part 23 is attached to one of the body 2 of the electronic instrument and the movable member 15, while the contact spring piece 32 is attached to the other of the body 2 of the electronic instrument and the movable member 15. Therefore, the body 2 of the electronic instrument and the movable member 15 can be securely electrically connected to each other. Therefore, the static electricity charged in the movable member 15 can be released outside the multifunctional electronic instrument 1 through the body 2 of the electronic instrument.

According to the multifunctional electronic instrument 1 described in ADDITIONAL REMARK 4, the parallel part 23 is attached to the movable member 15, while the contact spring piece 32 is attached to the body 2 of the electronic instrument. Therefore, the body 2 of the electronic instrument and the movable member 15 can be securely electrically connected to each other. Therefore, the static electricity charged in the movable member 15 can be released outside the multifunctional electronic instrument 1 through the body 2 of the electronic instrument.

Incidentally, the contents of Japanese Patent Application No. 2003-059169 are hereby incorporated by reference.

What is claimed is:

1. An electric contact structure comprising:

a first member including an electrically conductive base material and an electrically insulating surface layer formed on a surface of the base material;

an electrically conductive second member, which comes in contact with the first member;

a ruptured part of the surface layer of the first member, the ruptured part being formed by bending the first member; and an electric contact formed on the ruptured part, which comes in contact with the second member, thereby electrically connecting the base material of the first member and the second member to each other, wherein the second member is slidable in a planar direction while maintaining electrical contact with the base material of the first member.

2. The electric contact structure according to claim 1, wherein the ruptured part of the surface layer exposes the surface of the base material underlying the area of the ruptured part.

3. An electronic instrument comprising:

an electric contact structure;

a body of the electronic instrument; and a movable part provided to be movable relative to the body of the electronic instrument, wherein the electric contact structure comprises:

a first member, which includes an electrically conductive base material and an electrically insulating surface layer formed on a surface of the base material;

an electrically conductive second member which comes in contact with the first member;

a ruptured part of the surface layer of the first member, the ruptured part being formed by bending the first member; and an electric contact formed on the ruptured part, which comes in contact with the second member, thereby electrically connecting the base material of the first member and the second member to each other, and wherein the first member is attached to one of the body of the electronic instrument and the movable part, while the second member is attached to the other one of the body of the electronic instrument and the movable part.

4. The electric contact structure according to claim 3, wherein the ruptured part of the surface layer exposes the surface of the base material underlying the area of the ruptured part.

5. An electronic instrument comprising:

an electric contact structure;

a body of the electronic instrument; and a movable part provided to be movable relative to the body of the electronic instrument, wherein the electric contact structure comprises:

a first member which includes an electrically conductive base material and an electrically insulating surface layer formed on a surface of the base material;

an electrically conductive second member which comes in contact with the first member;

a ruptured part of the surface layer of the first member, the ruptured part being formed by bending the first member; and an electric contact formed on the ruptured part, which comes in contact with the second member, thereby electrically connecting the base material of the first member and the second member to each other, and wherein the first member is attached to the movable part while the second member is attached to the body of the electronic instrument.

6. The electric contact structure according to claim 5, wherein the ruptured part of the surface layer exposes the surface of the base material underlying the area of the ruptured part.

7. A process for producing an electric contact structure, in which a first member including an electrically conductive base material and an electrically insulating surface layer formed on a surface of the base material comes in contact with an electrically conductive second member so that the base material of the first member is electrically connected to the second member, the process comprising the steps of:

forming a ruptured part on the surface layer of the first member by bending the first member;

forming an electric contact on the ruptured part; and making the second member come in contact with the electric contact formed on the ruptured part, wherein the second member is slidable in a planar direction while maintaining electrical contact with the base material of the first member.

8. The electric contact structure according to claim 7, wherein the forming of the ruptured part on the surface layer exposes the surface of the base material underlying the area of the ruptured part.

* * * * *